United States Patent [19]

English et al.

[11] Patent Number: 4,612,000

[45] Date of Patent: Sep. 16, 1986

[54] SINGLE-ENDED METAL HALIDE DISCHARGE LAMPS AND PROCESS OF MANUFACTURE

[75] Inventors: George J. English, Reading; Harold L. Rothwell, Jr., Rowley, both of Mass.

[73] Assignee: GTE Products Corporation, Danvers, Mass.

[21] Appl. No.: 728,454

[22] Filed: May 1, 1985

Related U.S. Application Data

[63] Continuation of Ser. No. 502,772, Jun. 9, 1983, abandoned.

[51] Int. Cl.[4] ..... H01J 9/24

[52] U.S. Cl. ..... 445/6; 445/26; 313/634; 313/631

[58] Field of Search ..... 445/26, 6; 313/631, 313/632, 634

[56] References Cited

U.S. PATENT DOCUMENTS

| | | | |
|---|---|---|---|
| 3,259,777 | 7/1966 | Fridrich | 313/642 X |
| 4,161,672 | 7/1979 | Cap et al. | 313/634 X |
| 4,171,498 | 10/1979 | Fromm et al. | 313/116 |
| 4,321,504 | 3/1982 | Keeffe et al. | 313/642 X |
| 4,340,836 | 7/1984 | Bergman et al. | 313/631 |

*Primary Examiner*—Kenneth J. Ramsey

*Attorney, Agent, or Firm*—Jose' W. Jimenez; Thomas H. Buffton

[57] ABSTRACT

A single-ended metal halide discharge lamp including a fused silica elliptical-shaped envelope which is filled with a metal halide dosed high pressure mercury fill and wherein a pair of electrodes each having a metal rod with a ball on the end thereof are sealed whereby isothermal operation of the elliptical-shaped envelope is effected. A manufacturing process is also provided wherein an elliptical-shaped envelope is formed, a pair of electrodes having metal rods with a ball on the end thereof are sealed into one end of the envelope, and the envelope is filled with a metal halide dosed high pressure mercury fill.

5 Claims, 5 Drawing Figures

SINGLE-ENDED METAL HALIDE DISCHARGE LAMPS AND PROCESS OF MANUFACTURE

This application is a continuation of application Ser. No. 502,772, filed June 9, 1983, now abandoned.

CROSS REFERENCE TO OTHER APPLICATIONS

The following concurrently field applications relate to single-ended metal halide discharge lamps and the fabrication thereof: bearing U.S. Ser. Nos. 502,775; 502,773; 502,774 and 502,776 all filed June 9, 1983.

TECHNICAL FIELD

This invention relates to single-ended metal halide discharge lamps and the manufacture of such lamps and more particularly to single-ended metal halide discharge lamps having a stabilized arc and an envelope formed for isothermal operation.

BACKGROUND OF THE INVENTION

In the field of projectors, optical lens systems and similar applications requiring a relatively intense source of light, it has been a common practice to employ a light source in the form of a tungsten lamp. Although tungsten or tungsten halogen lamps do have certain desirable features such as low cost, desirable color features enhancing skin tones and do not require a special power source, several undesirable features are unfortunately also present. For example, structures employing a tungsten source do not generate enough blue light, tend to undesirably generate large amounts of heat which necessitates expensive and cumbersome cooling devices located adjacent the light source, and tend to exhibit a relatively short life such as an operational period of about 10 to 20 hours. Thus, it is not uncommon to replace light source each time the apparatus is employed. Obviously, such inconvenience and expense leaves much to be desired. Moreover, screen illumination is limited due to the inability to increase surface luminance much beyond 3400° K. while the mechanical body structure is rigid leading to destruction during operation by chemical means and by vibration or shock.

An improvement over the above-described system is provided by the use of metal halide discharge lamps as a light source. For example, a common form of high pressure metal halide discharge lamp is disclosed in U.S. Pat. No. 4,161,672. Therein, a double-ended arc tube or an arc tube having electrodes sealed into diametrically opposite ends is employed in conjunction with an evacuated or noble gas filled outer envelope. However, it has been found that such structures are relatively expensive to manufacture and are obviously not appropriate for use in projectors or other optic lens-type appartus.

As to single-ended metal halide arc discharge lamps, U.S. Pat. Nos. 4,302,699; 4,308,483; 4,320,322; 4,321,501 and 4,321,504 all disclose variations in structure or fill suitable to a particular application. However, any one or all of the above-mentioned patents leave something to be desired insofar as stability of the arc and isothermal uniformity of the discharge lamp are concerned.

OBJECTS AND SUMMARY OF THE INVENTION

An object of the present invention is to provide an improved single-ended high intensity discharge lamp. Another object of the invention is to ehance the capabilities of single-ended high intensity discharge lamps. Still another object of the invention is to provide a single-ended high intensity discharge lamp having an improved structural configuration. A further object of the invention is to provide an improved process for manufacturing single-ended high intensity discharge lamps.

These and other objects, advantages and capabilities are achieved in one aspect of the invention by a single-ended high pressure high intensity discharge lamp having a pair of electrodes each including a metal rod with a spherical ball on the end thereof sealed into and passing through one end of an elliptical-shaped envelope of fused silica containing a metal-bearing mercury fill therein.

In another aspect of the invention, a process for manufacturing single-ended metal halide discharge lamps is provided wherein a pair of electrodes each having a spherical ball on the end of a metal rod are sealed into one end of an elliptical-shaped fused silica envelope, and the envelope is filled with unsaturated metal-bearing mercury.

BEST MODE FOR CARRYING OUT THE INVENTION

For a better understanding of the present invention, together with other and further objects, advantages and capabilities thereof, reference is made to the following disclosure and appended claims in connection with the accompanying drawings.

Figure 1A:
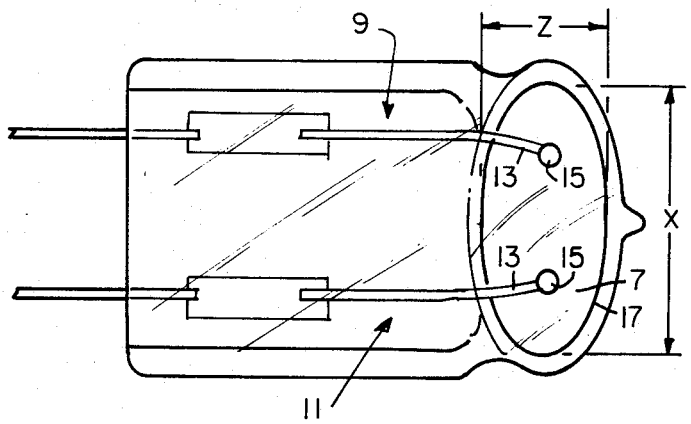
FIGS. 1A, and 1B are elevational and end view respectively of a single-ended high intensity discharge lamp of the invention.
Figure 1B:
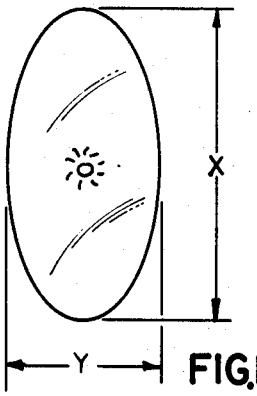
Figure 3:
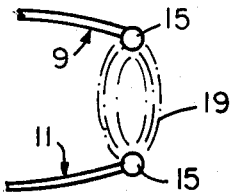
FIG. 3 is another illustration of the discharge lamp of FIG. 1 showing the approximate electric field lines of force between the electrodes of the lamp.

Referring to the drawings, FIGS. 1A and 1B illustrate a low wattage metal halide lamp having a body portion 5 of a material such as fused silica. This fused silica body portion 5 is formed to provide an elliptical-shaped interior portion 7 having a major and minor diametrical measurment, "X" and "Y" respectively, in a ratio of about 2:1. Moreover, the elliptical-shaped interior portion 7 preferably has a height "Z" substantially equal to the minor dimensional measurement "Y".

Sealed into one end of and passing through the body portion 5 is a pair of electrodes 9 and 11. Each of the electrodes 9 and 11 includes a metal rod 13 with a spherical ball 15 on the end thereof within the elliptical-shaped interior portion 7. Preferably, the electrodes 9 and 11 are positioned within the elliptical-shaped interior portion 7 in a manner such that the end of the spherical balls 15 of the electrodes 9 and 11 is substantially equally spaced from the interior portion 7 insofar as the major and minor axes "X" and "Y" and also substantially at the midpoint of the height "Z".

Also, a metal-bearing mercury fill is disposed within the elliptical-shaped interior portion 7. For example, mercury dosed with a metal halide such as sodium and scandium along with argon is an appropriate fill for a low wattage metal halide discharge lamp. Specifically, a 50-watt discharge lamp having an elliptical-shaped interior portion 7 with a volume of about 0.1 $Cm^3$ was filled with about 3.0 mgms of mercury, 1.9 mgms of sodium and scandium in a molar ratio of about 20:1 and argon at a pressure of about 200 torr. Operational testing provided an initial lumen output of about 3100 lumens with a lumen maintenance of about 84% after 160 hours of operational life.

Figure 2:
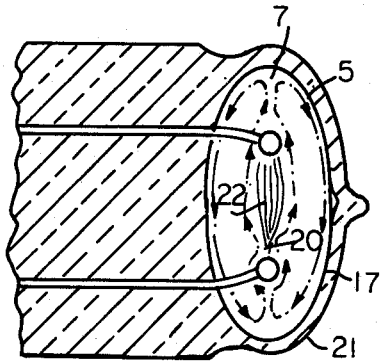
FIG. 2 is a diagrammatic illustration of the discharge and convection gas flow for vertical operation of the discharge lamp of FIG. 1.

Referring more specifically to the above-described elliptical-shaped interior portion 7, FIG. 2 of the drawings illustrates the electrodes 9 and 11 each having a spherical ball 15 thereon and spaced along the major axis "X" and substantially equal distance from the walls 17 of the interior portion 7. As can readily be seen, the body portion 5 is preferably vertically positioned such that the spherical balls 15 are located one above the other. As a result, a gas flow pattern is provided, as indicated by the arrows, wherein cool gas tends to flow down the outside wall 17 of the interior portion 7 and is drawn into the elliptical-shaped arc or plasma column 22 at the bottom electrode 11. The spherical ball 15 of the bottom electrode 11 provides a spherical extension, which will be explained hereinafter, and, in turn, produces gas flow pinching or a venturi action 20 at the arc terminus of the spherical ball 15 of the bottom electrode 11. In this manner, arc terminus wandering is minimized. Also, the gas atoms are heated in the plasma column 22, and the upper electrode 9 acts as a deflector which spreads the hot gases reaching the top of the body portion 5 of the elliptical-shaped arc turbe. Moreover, infrared measurements of the temperature of the wall 17 during operation of the arc tube indicate less than a 20° temperature variation at a wall temperature of about 1100° C. Thus, the above-described elliptical-shaped interior portion 7 and the elliptical-shaped arc 22 provide a convection current flow; 21 of FIG. 2, which is substantially uniform and free from undesired turbulence such that arc stability, which is particularly important in projectors and lens systems, is provided.

Figure 4:
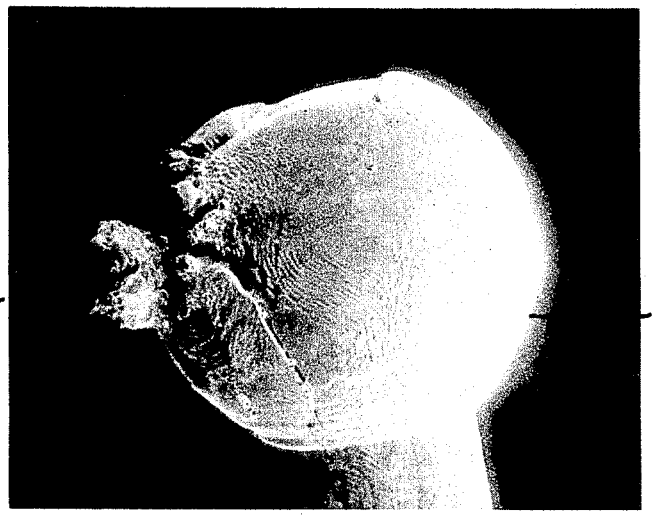
FIG. 4 is a photograph, 100×enlargement, of an electrode of the embodiment of FIG. 1.

Additionally, it has been noted that the above-described arc tends to wander about the contact region of the spherical balls 15 initially. However, it has been found that the employing of a seasoning step in the manufacturing process tends to cause development of protuberances 24 of (FIG. 4) on each one of the balls 15. As a result, the protuberances 24 tend to minimize the arc gap between the spherical balls 15 of the electrodes 9 and 11 and force the arc to have centrally located termination points on each of the electrodes 9 and 11.

Although not completely understood, it is believed that the above-described protuberances 24 of (FIG. 4) are of a size which depends upon the local material properties and the field strength and gas flow properties. Moreover, the growth formation also appears to be a function of the electrode size and temperature. Thus, the lower the operating temperature the longer the seasoning time required.

As a specific example, a 0.017-inch tungsten rod having a ball 15 thereon of about 0.025-inch was operated in a 100-watt metal halide filled discharge lamp drawing about 1.6 amperes of current. After about 15 minutes of "seasoning" at normal operational conditions, it was found that the arc stabilized and one or more protuberances appeared on the surface of the spherical balls 15 of the electrodes 9 and 11. Thus, the surface breakup into platelets and formation of the protuberances on the spheroid balls 15 inhibits any wandering of the arc and enhances the light source.

Additionally, it is to be noted that an arc source, such as a metal halide discharge lamp, provides not only higher luminance but also higher efficacy than a tungsten source. Also, a metal halide discharge lamp provides a point source relative to a tungsten source. Specifically, a 100-watt metal halide discharge lamp exihibits a plasma having a minimum luminance intermediate the spherical balls 15 and a maximum luminance at or near the spherical balls 15. Moreover, the plasma column is normally about 1 to 2 mm in diameter and about 3 mm in length. However, a tungsten source is about 2.5 mm in diameter and 8 mm in length with the luminance varying in a sinusoidal manner over the length of the tungsten source.

Following is a table, Table I, showing a comparison in luminance, efficacy and size of a tungsten source, a high pressure xenon source and a metal halide lamp source:

TABLE I

| | Luminance (Cd/mm) | Efficacy (Lumens/ Watt) | Size (Length × Diam.) | Theoretical Throughout (Lumens) |
|---|---|---|---|---|
| Tungsten (300 Watts) | 30 | 33 | 8 × 2.5 | 1980 |
| Xenon (150 Watts) | 150 | 20 | 2.2 × 5 | 600 |
| Metal Halide Lamp (100 Watts) | 75 | 65 | 3 × 1 | 1300 |

As can readily be seen, the tungsten source at 300 watts provides about 33 lumens per watt as compared with 65 L/W for a 100-watt metal halide lamp. Also, tests in a 35 mm projection system indicate an output of about 10,000 lumens from the 300-watt tungsten source is equivalent to that of the 6,500 lumens from the 100-watt metal halide lamp source. The long wavelength radiation and the misdirected visible light of the tungsten source tends to be absorbed as heat by the film of a projector. Thus, is has been found that the tungsten lamp generates about 270 watts of heat as compared to about 90 watts or about $\frac{1}{3}$ thereof by the metal halide lamp and associated power supply.

Further, the xenon source shows a relatively high luminance capability but a relatively low efficacy capability. Thus, a lumen output of the xenon source which is comparable to that provided by a 100-watt metal halide lamp would necessitate a xenon source of about 200 watts in order to compensate for a relatively poor efficacy capability. Moreover, a xenon source has a relatively small diameter, about 0.5 mm in the example, as compared with a metal halide lamp, about 1.0 mm, which greatly and undesirably reduces the tolerances or variations in positioned location of the arc source when employed with a reflector in a projection system. In other words, positional adjustment of an arc source in a xenon lamp is much more critical than in a metal halide discharge lamp system.

Accordingly, a single-ended metal halide discharge lamp has been provided wherein electrodes are disposed within an elliptical-shaped interior portion of a fused silica envelope. This elliptical-shaped envelope interior, in conjunction with an elliptical-shaped arc therein, provides a substantially isothermal operational condition of the fused silica envelope forming the discharge lamp. Morover, it has been found possible to provide a stabilized arc which is particularly important in the operation of projector and optic lens apparatus.

While there has been shown and described what is at present considered the preferred embodiments of the invention, it will be obvious to those skilled in the art that various changes and modifications may be made therein without departing from the invention as defined by the appended claims.

What is claimed is:

1. A process for manufacturing single-ended metal halide discharge lamps comprising the steps of;

forming an elliptical-shaped fused silica envelope;

sealing a pair of electrodes into one end of said elliptical-shaped envelope with each of said electrodes having a metal rod passing through said envelope and a spherical ball on the end of each metal rod within said envelope;

filling said elliptical-shaped envelope with a metal halide hosed high pressure mercury fill whereby substantially uniform heating of said elliptical-shaped envelope is effected; and seasoning said discharge lamp for a time and at a temperature sufficient to cause development of protuberances on said spherical balls of said electrodes whereby an arc stability is enhanced.

2. The process of claim 1 wherein said forming of said elliptical-shaped fused silica envelope is of a manner to produce major and minor axes of a ratio of about 2:1.

3. The process of claim 1 wherein said forming of said elliptical-shaped fused silica envelope is of a manner to produce major and minor axes and said electrodes are sealed into said envelope along said major axis in a manner to provide a substantially elliptical-shaped arc therebetween whereby spacing between said elliptically-shaped arc and elliptically-shaped envelope is substantially uniform.

4. The process of claim 1 wherein said filling of said elliptical-shaped envelope is effected with high pressure mercury doped with sodium and scandium.

5. In a metal halide discharge lamp manufacturing process wherein a pair of electrodes each having a metal rod with a spheroid ball thereon is sealed into one end of the envelope and a metal halide dosed high pressure mercury fill is dispensed into the envelope, the improvement wherein said envelope is an elliptical shape with major and minor axes in a ratio of about 2:1 whereby isothermal operation of elliptical-shaped envelope is substantially effected, said process including the step of seasoning said discharge lamp for a time and at a temperature sufficient to cause development of protuberances on said spherical balls of said electrodes.

* * * * *